United States Patent [19]

Stampfli

[11] 4,261,050

[45] Apr. 7, 1981

[54] ELECTRONIC WATCH HAVING A STEPPING MOTOR EQUIPPED WITH AN ALARM SYSTEM

[75] Inventor: Jean-Marcel Stampfli, Le Landeron, Switzerland

[73] Assignee: Ebauches Electroniques SA, Marin, Switzerland

[21] Appl. No.: 50,147

[22] Filed: Jun. 19, 1979

[30] Foreign Application Priority Data

Jul. 11, 1978 [CH] Switzerland ..... 7510/78

[51] Int. Cl.[3] ..... G04C 3/00

[52] U.S. Cl. ..... 368/259; 368/250; 368/73

[58] Field of Search ..... 58/23 D, 38 R, 21.1, 58/16 R, 19 R, 57.5; 368/73, 259, 260, 217–219, 85–87, 250, 273, 75

[56] References Cited

U.S. PATENT DOCUMENTS 4,068,461 1/1978 Fassett et al. ..... 368/73

*Primary Examiner*—Gene Z. Rubinson
*Assistant Examiner*—John B. Conklin
*Attorney, Agent, or Firm*—Wender, Murase & White

[57] ABSTRACT

An electronic watch having a stepping motor and equipped with an alarm, in which the number of power transistors necessary for the control of the stepping motor and of the alarm transducer is reduced so as to permit the integration of all the electronics of the watch of a single chip and to reduce the number of terminals of the integrated circuit and the number of interconnections.

A pair of the power transistors (5, 6) is common to the control of the motor coil (11) and of the alarm transducer coil (12) and the alarm control signal is inserted between the driving pulses.

7 Claims, 2 Drawing Figures

ELECTRONIC WATCH HAVING A STEPPING MOTOR EQUIPPED WITH AN ALARM SYSTEM

BACKGROUND OF THE INVENTION

As indicated in the American review "Jeweller's Circular-Keystone, February 1977", page 119, FIG. 4, electronic watches equipped with an alarm system generally use a bipolar transistor as a power output stage, controlling the alarm device. The bipolar transistor is excited by a signal coming from the integrated circuit of the watch, but is not comprised therein as it is not made in C-MOS technology.

It would be useful to integrate this component on the watch chip which would save time during the assembly thereof and would contribute in reducing the number of interconnections between the integrated circuit and components exterior thereto, such as the motor and the alarm transducer. However, and as indicated in the specifications of the integrated circuit E 010, made in C-MOS technology, for a watch having a stepping Microelectronic-Marin motor, the four motor control transistors themselves occupy an area of 0.914×2.032 mm, which is slightly greater than half of 1.803×2.032 mm of the watch chip.

The example of the E 010 integrated circuit, discussed above, shows that the power transistors occupy a large surface when they are made in C-MOS technology. On the other hand, to make the equivalent of a bipolar power transistor with Vce Sat=100 mV, it is necessary for the resistance of the drain-source channel of the MOS transistor to be of the order of 70 ohms. Such transistors have already been made for the control of stepping motors.

SUMMARY OF THE INVENTION

The object of the present invention is to reduce the number of power transistors necessary for the control of a stepping motor and of the electroacoustic alarm transducer so as to economise in the silicon surface required and permit the integration of all the electronics of the watch on a single chip. Another object of the invention is to make an economy in the surface of the substrate (printed circuit) and to reduce the number of interconnections and of output terminals of the integrated circuit.

According to the present invention there is provided an electronic watch having a stepping motor and provided with an alarm system, in which at least one part of the power transistors is common to the control of the stepping motor and to the control of the electroacoustic alarm transducer, the control signal of the alarm being inserted between the driving pulses of the motor.

BRIEF DESCRIPTION OF THE DRAWINGS

The invention will be described further, by way of example, with reference to the accompanying drawings, in which.

DESCRIPTION OF THE PREFERRED EMBODIMENTS

Figure 1:
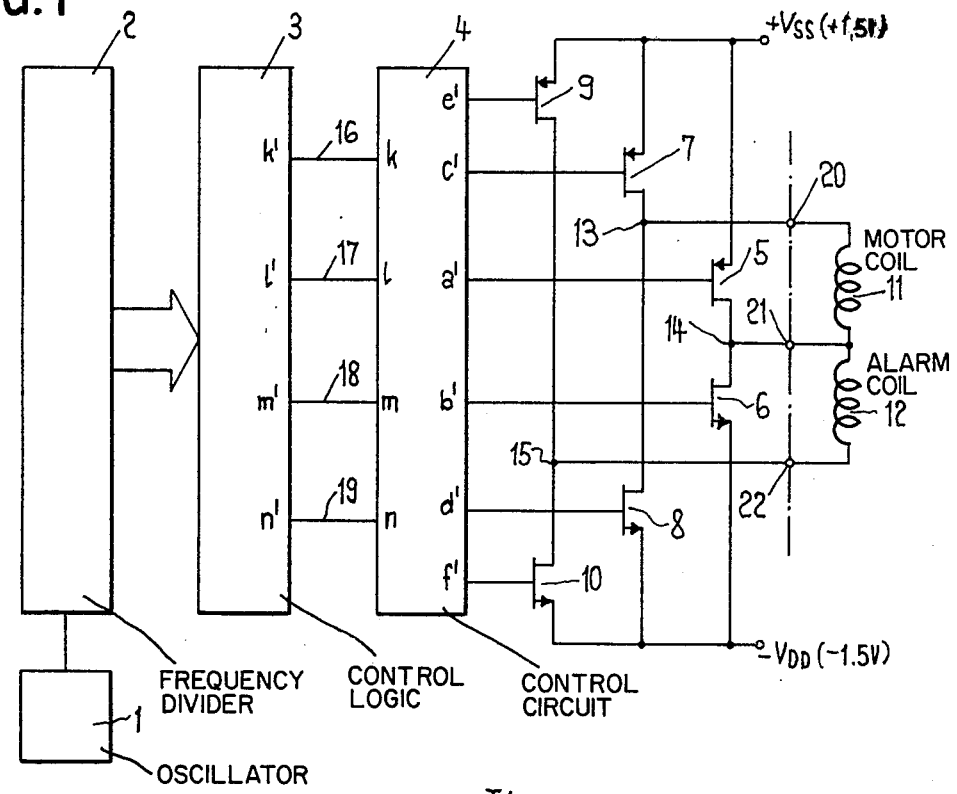
FIG. 1 is a block diagram of the electronic circuits of the watch in accordance with the invention, showing a system combining the power transistors.

In the diagram of FIG. 1, a quartz crystal oscillator 1 feeds the frequency divider chain 2, the output signals of which control a control logic 3 which provides signals 16, 17, 18 and 19, necessary to control the stepping motor and the alarm transducer, at its outputs k', l', m', n'. These signals arrive at the inputs k, l, m, n of the control circuit 4 which decodes the signals to produce the control electrode drive signals delivered to the power transistors 5, 6, 7, 8, 9 and 10 forming the output circuit, at its outputs a', b', c', d', e' f'. The motor, the driving coil 11 of which is shown in FIG. 1, is connected to the integrated circuit by the terminals 20 and 21. The terminal 20 is connected to the common point 13 of the complementary transistors 7 and 8 and the terminal 21 is connected to the common point 14 of the complementary transistors 5 and 6. The coil 12 is that of the electroacoustic transducer, which can be of the electrodynamic or electromagnetic type and the control characteristic of which is comparable to that of the stepping motor. This coil is connected to the terminals 21 and 22 of the integrated circuit. The terminal 22 is connected to the common point 15 of the complimentary transistors 9 and 10. The terminal 21 is thus common to the motor and to the alarm transducer. The transistors 5, 6, 7 and 8 control the motor and the transistors 5, 6, 9 and 10 control the alarm transducer. Consequently, the transistors 5 and 6 are common to the motor and to the transducer. This arrangement thus permits a saving of two power transistors and allowing the control of the coils 11 and 12 with the aid of six power transistors instead of eight. There results in an appreciable surface economy due to the omission of two power transistors. The transistors 5 to 10 of the output circuit, which are made in C-MOS technology can then be integrated on the same chip as the other electronic circuits 1 to 4 of the watch. Due to the fact that the terminal 21 is common to the coil 11 of the motor and to the coil 12 of the transducer, the arrangement of the circuit reduces the number of output terminals by one. Likewise, since the power transistors now form part of the integrated circuit, the interconnections are reduced to a minimum and are thus reduced to three connections between the coils 11 and 12 and the terminals 20, 21 and 22 of the integrated circuit.

In so far as concerns the functioning of the output circuit comprising the power transistors 5 to 10, each coil 11, 12 is fed by a bridge formed by four transistors. This bridge arrangement permits the control of the coils 11 and 12 by a point to point voltage the value of which is double that of the supply voltage. Thus, with a supply voltage of 1.55 V the point to point voltage at the terminals of each of the coils 11 or 12 would be 3.10 V. Due to the fact that the transistors 5 and 6 are common to the control of the motor and of the alarm transducer, the circuit of FIG. 1 does not permit the alarm signal to be given simultaneously with the driving pulses. The alarm signal must be coupled between the driving pulses by means of an appropriate logic, such as the control logic 3. A circuit producing the lag of the alarm pulses with respect to the driving pulses is described for example in the Swiss patent application No. CH 15 775/77 of the applicant.

Figure 2:
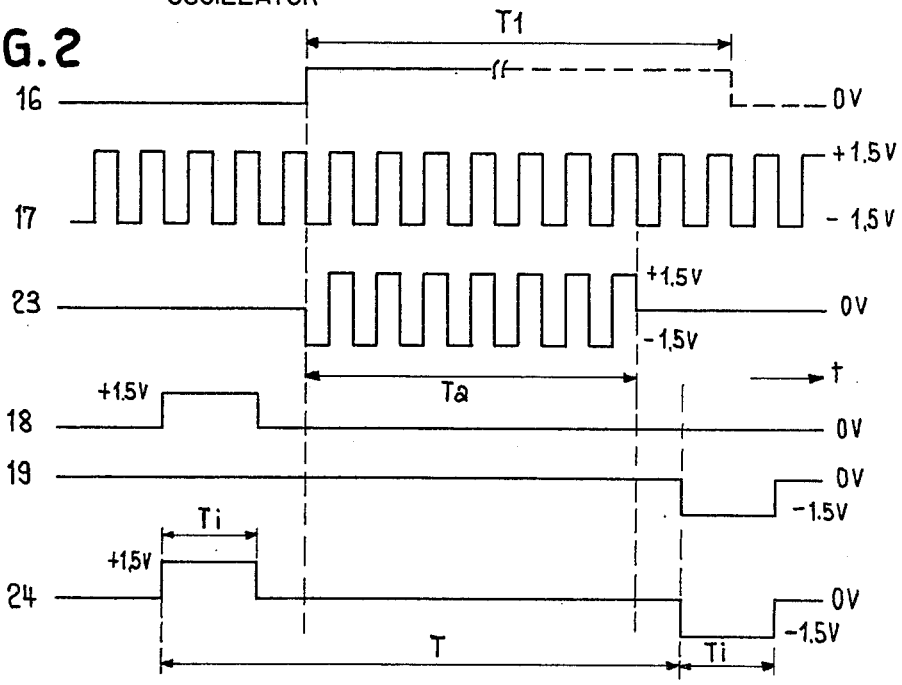
FIG. 2 is a pulse diagram illustrating schematically the control principle of the power transistors.

FIG. 2 shows schematically the control signals of the motor and of the alarm, provided by the control logic 3. The signal 16 is the alarm coincidence signal, of duration T1. The signal 17 is the acoustic frequency signal, for example 2048 Hz, schematically represented, and adapted to excite the alarm transducer. The signal 23 represents an alarm impulse train of duration Ta derived from the logic 3 and presented to the terminals of the alarm coil 12. The signal 18 is a first driving pulse and the signal 19 a second driving pulse for the control of the motor. These driving pulses have a duration Ti and they are time-lagged by a duration T. The signal 24, present at the terminals of the motor coil 11, is the combination of the signals 18 and 19. This figure shows that the signal 23 which controls the alarm, only appears between the motor control driving pulses (signal 24). Of course, the alarm pulse trains of duration Ta are repeated during each time interval T, between two consecutive driving pulses, and this until the end of the alarm duration T1.

I claim:

1. In an electronic watch having a stepping motor, an electroacoustic alarm system, control circuits for producing motor control pulses and alarm system control pulses, with the alarm system control pulses only being produced when the motor control pulses are not present, and a drive network coupling the control circuit pulses to the stepping motor and the alarm system, the improvement wherein said drive network comprises:

first means including a plurality of power transistors for driving the stepping motor in response to the motor control pulses;

second means including a plurality of power transistors for driving the alarm system in response to the alarm system control pulses; and said first means and said second means having at least one of said power transistors in common.

2. An electronic watch in accordance with claim 1, wherein said power transistors are C-MOS transistors and the drive network is included in an integrated circuit comprising the control circuits of the watch.

3. An electronic watch in accordance with claim 2, wherein said stepping motor and said alarm system are connected to the drive network included in said integrated circuit via terminals and the number of said terminals comprising said connections is three.

4. An electronic watch in accordance with claim 1, wherein the alarm system is of the electrodynamic type.

5. An electronic watch in accordance with claim 1, wherein the alarm system is of the permanent magnet type.

6. An electronic watch in accordance with claim 1, wherein the alarm system is of the piezo-electric type.

7. An electronic watch in accordance with claim 1, wherein said first driving means comprises a first and a second pair of power transistors and said second driving means comprises said second pair and a third pair of power transistors, each of said pairs of power transistors including two complementary transistors connected in series between the positive and negative lines of a power supply, the stepping motor being connected via a first terminal to the common point of said first pair of transistors and by a second terminal to the common point of said second pair of transistors, and the alarm system being connected via said second terminal to said second pair of transistors and by a third terminal to the common point of said third pair of transistors, said second terminal and said second pair of transistors thereby being common to both the motor and the alarm system.

* * * * *